US005564665A

United States Patent [19]

Resnick

[11] Patent Number: 5,564,665

[45] Date of Patent: Oct. 15, 1996

[54] CANDLE STICK RECEPTACLE ADAPTER

[75] Inventor: Mark I. Resnick, New York, N.Y.

[73] Assignee: FRW Inc., South Orange, N.J.

[21] Appl. No.: 493,635

[22] Filed: Jun. 22, 1995

[51] Int. Cl.[6] ..... F16M 13/00

[52] U.S. Cl. ..... 248/519; 220/445; 220/448; 248/146; 248/346.03; 248/539; 248/311.2

[58] Field of Search ..... 248/127, 146, 248/310, 314, 346.01, 346.03, 411, 412, 414, 606, 519, 539; 220/410, 445, 448, 739; 403/228, 226, 225, 223, 220

[56] References Cited

U.S. PATENT DOCUMENTS

| | | | |
|---|---|---|---|
| 1,856,000 | 4/1932 | Smith | 248/519 |
| 2,111,642 | 3/1938 | Larymore | 403/225 X |
| 2,319,760 | 5/1943 | Becwar | 403/225 X |
| 2,661,969 | 12/1953 | Thiry | 403/228 X |
| 3,153,123 | 10/1964 | Harman | 248/414 X |
| 4,226,355 | 10/1980 | Helfrich, Jr. | 248/146 |
| 4,569,246 | 2/1986 | Katayama et al. | 403/225 X |
| 4,768,393 | 9/1988 | Beaman | 403/225 X |

*Primary Examiner*—Ramon O. Ramirez
*Assistant Examiner*—Michael J. Turgeon
*Attorney, Agent, or Firm*—Ohlandt, Greeley, Ruggiero & Perle

[57] ABSTRACT

An adapter for securely disposing an elongated member within a candle stick receptacle, the adapter comprises: a first support means disposed about the outer surface of the elongated member and near a first end of the elongated member, wherein the first support means is capable of providing a secure fit between the outer surface of the elongated member and an inner surface of a candle stick receptacle; and a second support means disposed about the outer surface of the elongated member and between the first support means and a second end of the elongated member, wherein the second support means is capable of providing vertical stability for the elongated member disposed within the candle stick receptacle.

17 Claims, 2 Drawing Sheets

CANDLE STICK RECEPTACLE ADAPTER

The present invention generally relates to an adapter which is capable of converting a standard candle stick receptacle into a device which is capable of holding flower bud vases and the like.

BACKGROUND OF THE INVENTION

Candle stick receptacles can be extremely attractive pieces of art or heirlooms which until now have been used solely for the purpose of supporting candle sticks therein. However, with the advent of electricity the number of times which a candle stick is actually used has substantially diminished. Therefore, these beautiful art works or show pieces are not being utilized or displayed to there fullest potential.

The present inventor has developed a unique adapter which will allow candle stick receptacles to be used for purposes other than for the displaying of candle sticks. For example, the candle stick receptacle adapter according to the present invention will allow the disposition of a flower bud vase within the candle stick receptacle, thereby providing a completely unrelated function therefor, i.e., the holding of flowers. Therefore, instead of storing away beautiful pieces of art work in the form of candle stick receptacles, the adapter of the present invention would allow for their use in other areas where they may be more prominently displayed throughout a house or office environment.

The present invention also provides many additional advantages which shall become apparent as described below.

SUMMARY OF THE INVENTION

An adapter for securely disposing an elongated member, e.g., a cylindrical container, within a candle stick receptacle. The adapter comprises a first support means disposed about the outer surface of the elongated member and near a first end of the elongated member, wherein the first support means is capable of providing a secure fit between the outer surface of the elongated member and an inner surface of the candle stick receptacle, and a second support means disposed about the outer surface of the elongated member and between the first support means and a second end of the elongated member, wherein the second support means is capable of providing vertical stability for the elongated member disposed within the candle stick receptacle.

The first support means is typically a compressible material affixed about the outer surface of the elongated member by means of an adhesive, e.g., an acrylate or rubber-based adhesive. The second support means is preferably a first o-ring which has a portion thereof with a reduced diameter compared to the diameter of the remainder of the first o-ring, and a second o-ring which is disposed about the reduced diameter portion the first o-ring.

Optionally, an ornament holder can be disposed about the top portion of the elongated member for the purpose of adorning the elongated member with various decorative ornaments. The ornament holder preferably comprises a collar portion and an upper ring portion disposed substantially perpendicular to the collar portion, wherein the collar portion is disposed about the inner surface of the elongated member and the upper ring portion is disposed about the top edge of the second end of the elongated member.

Other and further objects, advantages and features of the present invention will be understood by reference to the following specification in conjunction with the annexed drawings, wherein like parts have been given like numbers.

DESCRIPTION OF THE PREFERRED EMBODIMENTS

Figure 1:
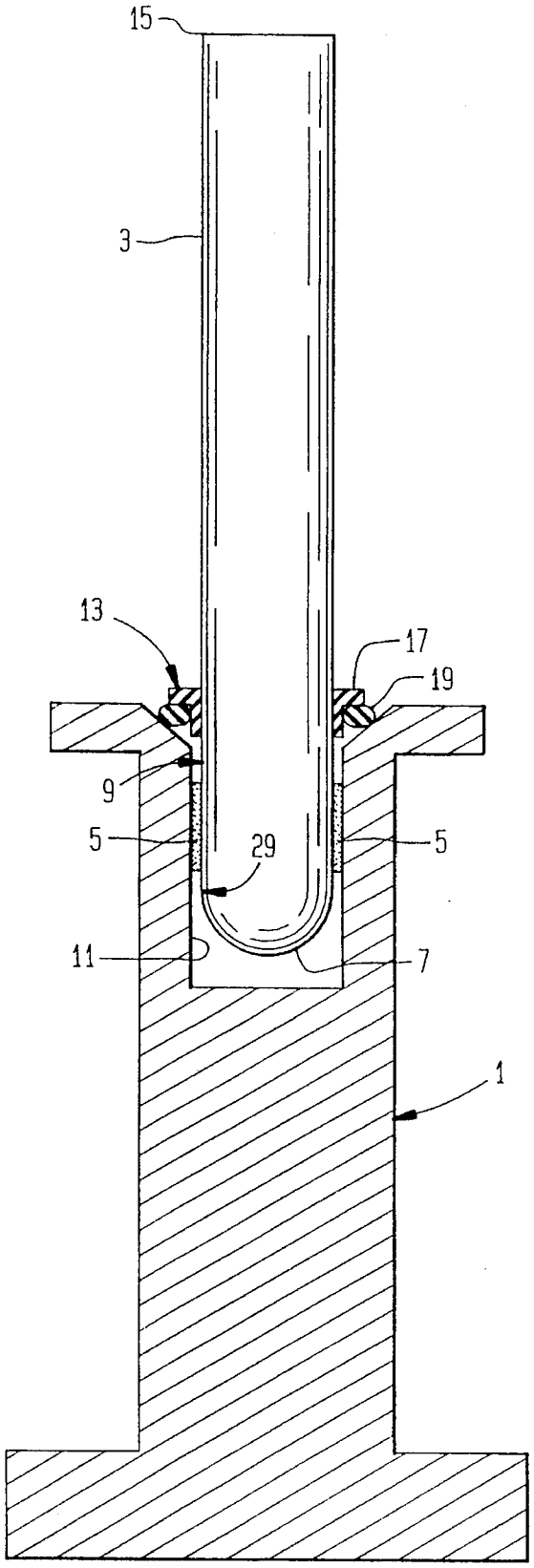
FIG. 1 is a schematic cross-sectional view of a candle stick receptacle having an adapter according to the present invention with an elongated member disposed therein.
Figure 2:
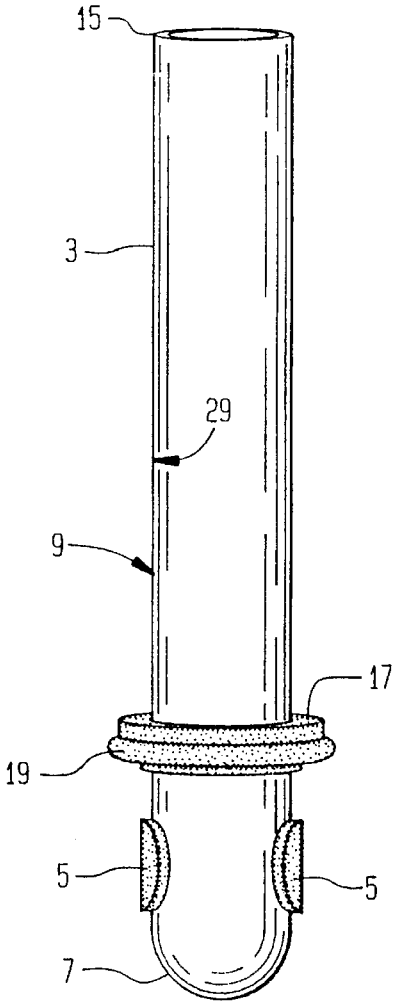
FIG. 2 is a side perspective view of a candle stick receptacle adapter having an elongated member disposed therein according to one embodiment of the present invention.
Figure 3:
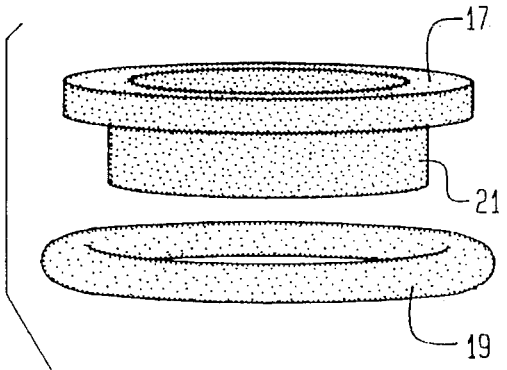
FIG. 3 is a top side perspective view of a pair of o-rings used in forming the candle stick receptacle adapter according one embodiment of the present invention.

The present invention can best be described by referring to the drawings wherein FIGS. 1–3 depict a candle stick receptacle 1 which has been converted so that is able to hold an elongated member 3, e.g., a cylindrical container such as a flower bud vase, therein according to the present invention. The reason why elongated member 3 can be securely disposed within candle stick receptacle 1 is due to the use of the unique adapter developed by the present inventor.

The adapter used for securely disposing elongated member 3, e.g., a cylindrical container, within candle stick receptacle 1 comprises: a first support means 5 disposed about the outer surface of elongated member 3 and near a first end 7 of elongated member 3, wherein first support means 5 is capable of providing a secure fit between the outer surface 9 of elongated member 3 and an inner surface 11 of candle stick receptacle 1; and a second support means 13 disposed about outer surface 9 of elongated member 3 and between first support means 5 and a second end 15 of elongated member 3, wherein second support means 13 is capable of providing vertical stability for elongated member 3 disposed within candle stick receptacle 1.

First support means 5 is preferably a compressible material affixed about outer surface 9 of elongated member 3. The compressible material is selected from one material consisting of: felt, cotton, nylon, acrylic, synthetic elastomers, natural rubber, and any other compressible synthetic or natural material. First support means 5 typically has a diameter of between about ¾" to ⅝". First support means 5 can be affixed about outer surface 9 of elongated member 3 by any known means, such as an adhesive. The adhesive is typically either an acrylate or rubber-based adhesive.

If elongated member 3 is to be used to contain a liquid substance such as water, it is preferable to provide a seal about first end 7 such that it is capable of retaining liquid therein while disposed within candle stick receptacle 1. Elongated member 3 is formed from at least one material selected from the group consisting of: glass, ceramic, plastic or polymeric materials, metals, or metal alloys.

Second support means 13 is preferably at least one o-ring 17 which has a diameter that is large enough such that when o-ring 17 is disposed about elongated member 3 it contacts the inner surface 11 of candle stick receptacle 1 or at least contacts the top surface in shallow or narrow candle stick receptacles. O-ring 17 is disposed about the entire outer circumference of elongated member 3. It is more preferable that second support means 13 have a first o-ring 17 and a second o-ring 19. First o-ring 17 has a portion 21 thereof which has a reduced diameter with respect to the diameter of the remainder of first o-ring 17. Reduced diameter portion 21 is preferably disposed adjacent to first support means 5. Second o-ring 19 is typically disposed about reduced diameter portion 19 of first o-ring 17. Second support means 13 is movably adjustable about elongated member 3 to allow its use in candle stick receptacle having varying depths.

O-rings 17 and 19 are preferably formed of a material selected from the group consisting of: synthetic elastomers, natural rubber, plastics or any other polymeric material. Alternatively, the o-rings may be formed as one piece, extruded or molder.

Figure 4:
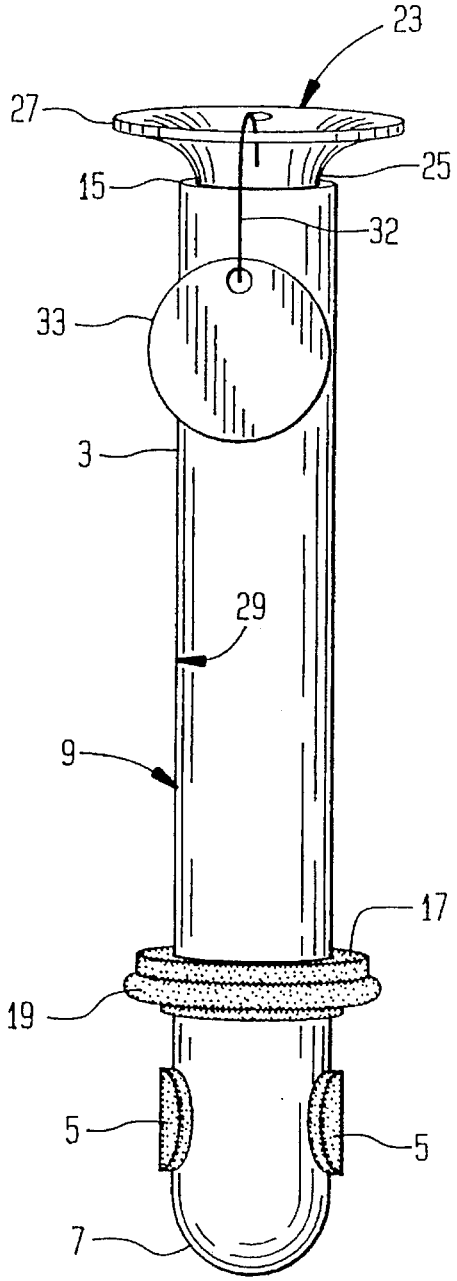
FIG. 4 is a side perspective view of an ornament holder disposed about the top of an elongated member having a candle stick receptacle adapter disposed about the opposite end of the elongated member.
Figure 5:
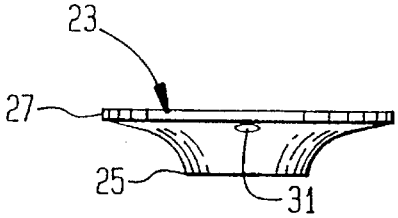
FIG. 5 is a side perspective view of the ornament holder shown in FIG. 4.
Figure 6:
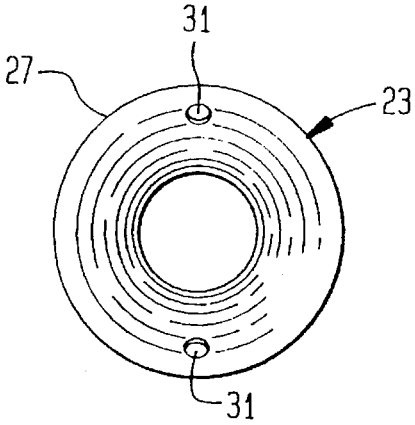
FIG. 6 is a top plan view of the ornament holder shown in FIG. 4.

FIGS. 4–6 depict an ornament holder 23 disposed about second end 15 of elongated member 3. Ornament holder 23 comprises a collar portion 25 and an upper ring portion 27 disposed substantially perpendicular to collar portion 25, wherein collar portion 25 is disposed about inner surface 29 of elongated member 3 and upper ring portion 27 is disposed about the top edge of second end 15 of elongated member 3. Upper ring portion 27 comprises at least one means 31 for securing ornaments 33 therefrom preferably by means of hanging wire 32. Means 31 for securing ornaments 33 therefrom is preferably a through-hole.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of the appended claims.

What is claimed is:

1. A candle stick receptacle assembly which is capable of replaceably disposing an elongated member having at least an outer surface disposed within a candle stick receptacle by means of an adapter, said assembly comprises:

a candle stick receptacle;

an elongated member which is a container, and an adapter which comprises: a first support means disposed about said outer surface of said elongated member and near a first end of said elongated member, wherein said first support means is capable of providing a secure fit between said outer surface of said elongated member and an inner surface of said candle stick receptacle, provided that said first support means is not affixed to said inner surface of said candle stick receptacle; and a second support means disposed about said outer surface of said elongated member and between said first support means and a second end of said elongated member, wherein said second support means is capable of providing vertical stability for said elongated member disposed within said candle stick receptacle, provided that said second support means is not affixed to said inner surface of said candle stick receptacle.

2. The assembly according to claim 1 wherein said first support means is a compressible material affixed about said outer surface of said elongated member.

3. The assembly according to claim 2 wherein said compressible material is selected from the group consisting of: felt, cotton, nylon, acrylic, synthetic elastomers and natural rubber.

4. The assembly according to claim 2 wherein said compressible material is affixed about said outer surface of said elongated member by means of an adhesive.

5. The assembly to claim 4 wherein said adhesive is either an acrylate or rubber-based adhesive.

6. The assembly according to claim 1 further comprising a bottom portion disposed about said first end of said elongated member in such a way that said elongated member is capable of retaining liquid therein while disposed within said candle stick receptacle.

7. The assembly according to claims 1 wherein said elongated member is formed from at least one material selected from the group consisting of: glass, ceramic, plastic or polymeric materials, metals or metal alloys.

8. The assembly according to claim 1 wherein said second support means is at least one o-ring.

9. The assembly according to claim 8 wherein said second support means comprises a first o-ring and a second o-ring.

10. The assembly according to claim 9 wherein said first o-ring has a recessed portion thereof which has a smaller diameter than the overall diameter of said first o-ring, said recessed portion being disposed adjacent to said first support means.

11. The assembly according to claim 10 wherein said second o-ring is disposed about said recessed portion of said first o-ring.

12. The assembly according to claim 8 wherein said o-ring is formed of a material selected from the group consisting of: synthetic elastomers, natural rubber, plastics and polymeric material.

13. The assembly according to claim 8 wherein said second support means is reciprocally disposed about said outer surface of said elongated member.

14. The assembly according to claim 1 further comprising an ornament holder being disposed about said second end of said elongated member.

15. The assembly according to claim 14 wherein said ornament holder comprises a collar portion and an upper ring portion disposed substantially perpendicular to said collar portion, wherein said collar portion is disposed about the inner surface of said elongated member and said upper ring portion is disposed about said second end of said elongated member.

16. The assembly according to claim 15 wherein said upper ring portion comprises at least one means for securing ornaments therefrom.

17. The assembly according to claim 16 wherein said means for securing ornaments therefrom is a through-hole.

* * * * *